US006799817B1

(12) United States Patent
Chu

(10) Patent No.: US 6,799,817 B1
(45) Date of Patent: Oct. 5, 2004

(54) AUTO-LOCKING STRUCTURE OF A SLIDING TRACK ASSEMBLY FOR DRAWER

(75) Inventor: Leo Chu, Chungho (TW)

(73) Assignee: Dynaslide Corporation, Taipei Hsien (TW)

( * ) Notice: Subject to any disclaimer, the term of this patent is extended or adjusted under 35 U.S.C. 154(b) by 0 days.

(21) Appl. No.: 10/318,132

(22) Filed: Dec. 13, 2002

(51) Int. Cl.[7] ..... A47B 88/00

(52) U.S. Cl. ..... 312/333; 312/334.11; 312/334.46; 312/334.8; 312/330.1

(58) Field of Search ..... 312/334.7, 334.8, 312/334.11, 334.44, 334.46, 330.1, 333, 334.1, 334.47

(56) References Cited

U.S. PATENT DOCUMENTS 5,433,517 A * 7/1995 Fleisch ..... 312/334.8
5,484,209 A * 1/1996 Weng ..... 384/18
5,577,821 A * 11/1996 Chu ..... 312/334.11
5,757,109 A * 5/1998 Parvin ..... 312/334.11
6,390,575 B1 * 5/2002 Chen et al. ..... 312/334.46
6,497,464 B1 * 12/2002 Cammack et al. ..... 312/333

* cited by examiner

*Primary Examiner*—Peter M. Cuomo
*Assistant Examiner*—Sarah C. Burnham
(74) *Attorney, Agent, or Firm*—Troxell Law Office PLLC

(57) ABSTRACT

An auto-locking structure used in a sliding track assembly for drawer is constructed to include a track located on the rear side of the outer sliding rail of the sliding track assembly, a sliding locking block sliding in the track and adapted to alternatively lock the inner sliding rail between the extended and received positions, and a tensile spring connected between the track and sliding locking block, the sliding locking block having a side locating hole defined between a sloping wall and a stop wall and an opening adjacent to the side locating hole for positively secure the inner sliding rail in the extended or received position.

3 Claims, 12 Drawing Sheets

AUTO-LOCKING STRUCTURE OF A SLIDING TRACK ASSEMBLY FOR DRAWER

BACKGROUND AND SUMMARY OF THE INVENTION

The present invention relates to a sliding track assembly for drawer and, more specifically, to an auto-locking structure used in a sliding track assembly for drawer.

FIG. 1 illustrates an auto-locking structure used in a sliding track assembly for drawer according to the prior art. According to this design, the auto-locking structure comprises a seat 911, a spring member 912 and a link 913 respectively installed in the outer sliding rail 91, and an engagement block 921 installed in the inner sliding rail 92. This design of auto-locking structure is not satisfactory in function. Because the seat 911 occupies much rear side space of the outer sliding rail 91, it weakens the functioning of the outer sliding rail 91 to bear the load.

It is the main object of the present invention to provide an auto-locking structure for use in a sliding track assembly for drawer, which requires less installation space in the sliding track assembly. It is another object of the present invention to provide an auto-locking structure for use in a sliding track assembly, which does not weaken the functioning of the sliding track assembly to bearing the load. According to one aspect of the present invention, the auto-locking structure comprises a track fastened to the outer sliding rail of the sliding track assembly, a sliding locking block movably supported in the track, a spring member connected between the track and the sliding locking block, and a push block located on the inner sliding rail of the sliding track assembly. The track provides a sliding groove formed of a linear front sliding groove portion and a arched rear sliding groove portion and a hook hole biased from the front side of the linear front sliding groove portion to match the sliding locking block. The sliding locking block has a locating rod, a sloping wall, and a side locating hole. The push block has a push rod adapted to mach the sliding locking block to achieve an auto-locking action. Because the track and the sliding locking block have a limited size, they occupy small installation space in the outer sliding rail without affecting the functioning of the sliding track assembly to carry the load. According to another aspect of the present invention, when the inner sliding rail pushed backwards to force the back sidewall of the sliding locking block against the front sidewall of the first locating block of the track, the rear end of one lateral sidewall of the inner sliding rail is automatically forced into engagement with a clamping portion of the first locating block of the track, and therefore the inner sliding rail is positively held in position. According to still another aspect of the present invention, the sliding locking block has an opening adjacent to the sloping wall and the side locating hole, such that the sloping wall of the sliding locking block can be deformed by the push rod of the push block for enabling the push rod to move into the side locating hole to achieve an locking action when the sliding locking block forced by an unexpected external force and pulled backwards by the spring member.

DETAILED DESCRIPTION OF THE PREFERRED EMBODIMENT

Figure 1:
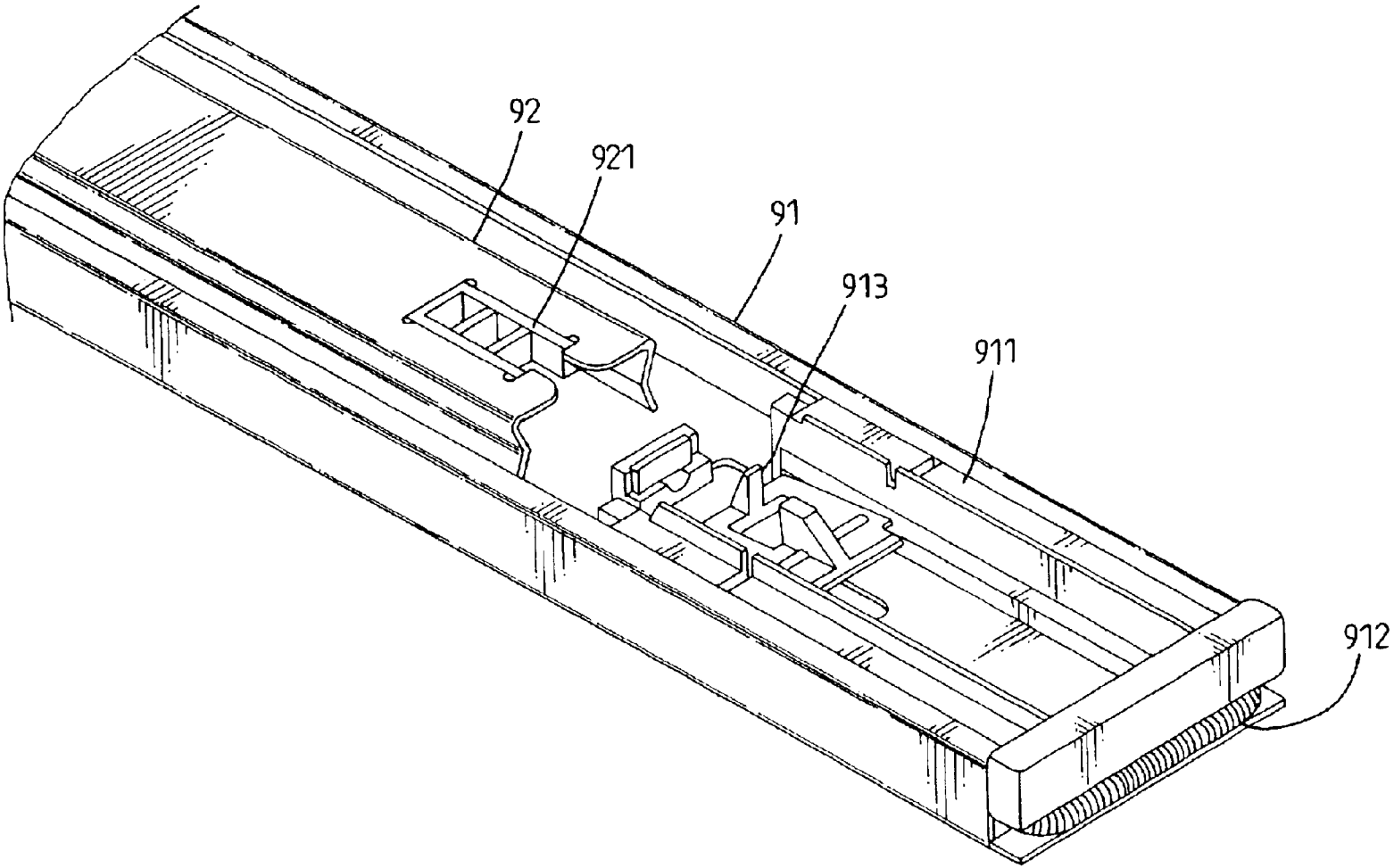
Fig.1 PRIOR ART
FIG. 1 is an elevational view of the prior art design.

Referring to Figures from 2 through 16, an auto-locking structure in accordance with the present invention is used in a sliding track assembly for drawer. The sliding track assembly comprises an outer sliding rail 2, an intermediate sliding rail 7, an inner sliding rail 1, a first ball bearing plate (not shown) provided between the outer sliding rail 2 and the intermediate sliding rail 7, and a second ball bearing plate 82 provided between the intermediate sliding rail 7 and the inner sliding rail 2. The outer sliding rail 2 is fixedly fastened to the inner sidewall of the desk (not shown) at one side of the drawer receiving space. The inner sliding rail 1 is fixedly fastened to one vertical side panel of the drawer (not shown), for enabling the drawer to be moved in and out of the drawer receiving space within the desk. The drawer can be detached with the inner sliding rail 1 from the intermediate sliding rail 7 and the outer sliding rail 2. The intermediate sliding rail 7 comprises a locating block 71 in the outer end. The locating block 71 has a protruded engagement portion 712. The inner sliding rail 1 comprises a retaining strip 12 for detachably engaging the protruded engagement portion 712 of the locating block 71 of the intermediate sliding rail 7.

The auto-locking structure is comprised of a push block 4, a sliding locking block 5, a tensile spring 50, and a track 6. The push block 4 has an insert portion 43 press-fitted into a locating hole 19 in the rear end of the inner sliding rail 1, and a mounting hole 41 fixedly fastened to the inner sliding rail 1 by a fastening element 44. The sliding locking block 5 is fastened to one end 501 of the tensile spring 50. The track 6 is fixedly fastened to the outer sliding rail 2 near its rear end. When the drawer moved with the inner sliding rail 1 backwards to the inside of the drawer receiving space of the desk, the push block 4 pushes the sliding locking block 5 backwards to the locking position.

Figure 9:
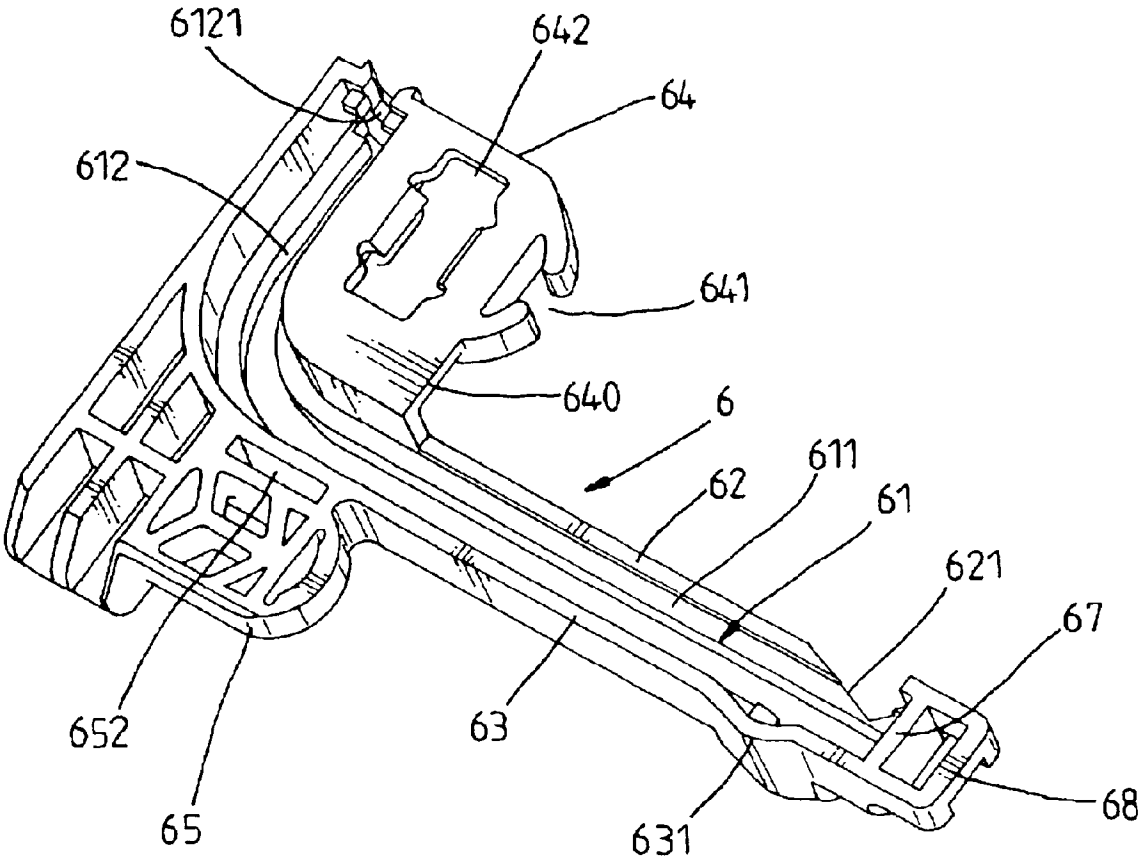
FIG. 9 is an oblique bottom elevation of the track shown in FIG. 7.

The main features of the present invention are outlined hereinafter. The track 6 comprises a sliding groove 61 formed of a linear front sliding groove portion 611 and an arched rear sliding groove portion 612 (see FIG. 9), a low stop wall 62 extended along one side of the linear front sliding groove portion 611, a first locating block 64 at the rear side of the low stop wall 62 adjacent to the arched rear sliding groove portion 612, a clamping portion 641 protruded from one side of the first locating block 64, a high stop wall 63 extended along the other side of the linear front sliding groove portion 611, a second locating block 65 at the rear side of the high stop wall 63 opposite to the first locating block 64, a retaining hole 6121 in between the second locating block 65 and the rear side of the arched rear sliding groove portion 612 for the positioning of the other end 502 of the tensile spring 50, a front stop wall 67 in the front side of the linear front sliding groove portion 611, a hook hole 661 biased from the front side of the linear front sliding groove portion 611 behind the front stop wall 67, and a stop block 66 provided between the hook hole 661 and the linear front sliding groove portion 611. The high stop wall 63 has an outwardly curved protruded portion 631 extended along one side of the hook hole 661 The low stop wall 62 has a front notch 621 corresponding to the outwardly curved protruded portion 631 of the high stop wall 63.

Figure 7:
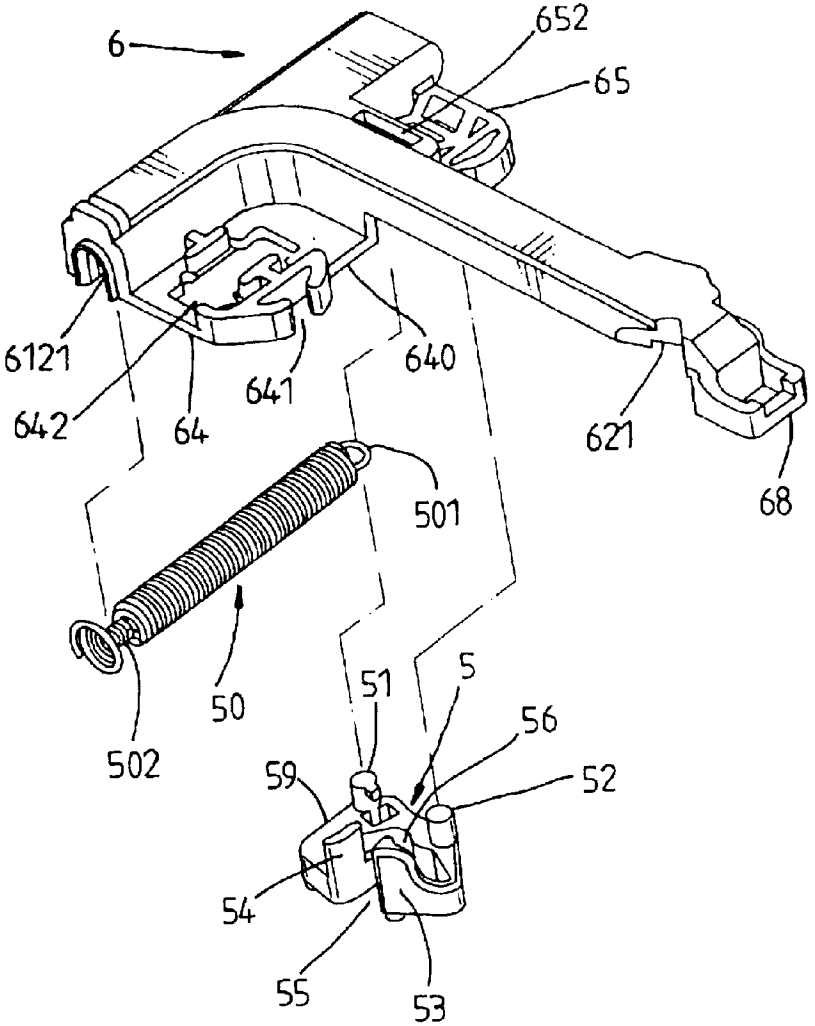
FIG. 7 is an enlarged view of a part of FIG. 6.

The sliding locking block 5 (see FIGS. 7, 10, and 11) comprises a hook rod 51 and a locating rod 52 respectively inserted into the linear front sliding groove portion 611 of the sliding groove 61 of the track 6 to guide movement of the sliding locking block 5 in the sliding groove 61, a sloping wall 53 and a stop wall 54 disposed at one side opposite to the hook rod 51 and the locating rod 52, a side locating hole 55 defined between the sloping wall 53 and the stop wall 54. The push block 4 has a push rod 42.

Figure 15:
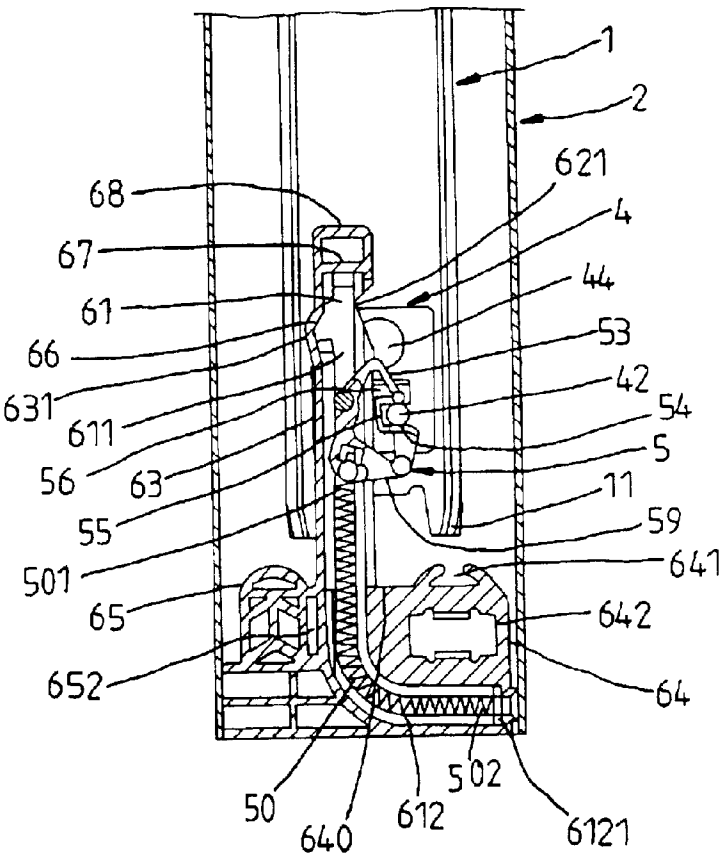
FIG. 15 is a top plain view of the present invention showing the push rod of the push block forced into engagement with the sliding locking block.
Figure 14:
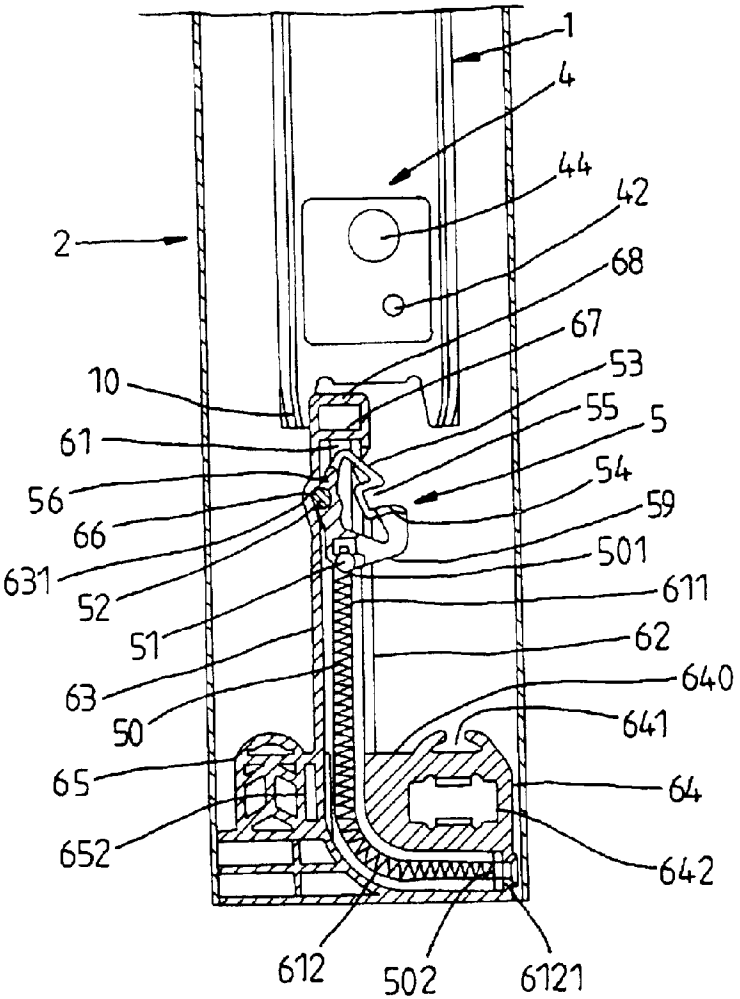
FIG. 14 is a top plain view of the present invention showing the push block moved with the inner sliding rail away from the sliding locking block.
Figure 16:
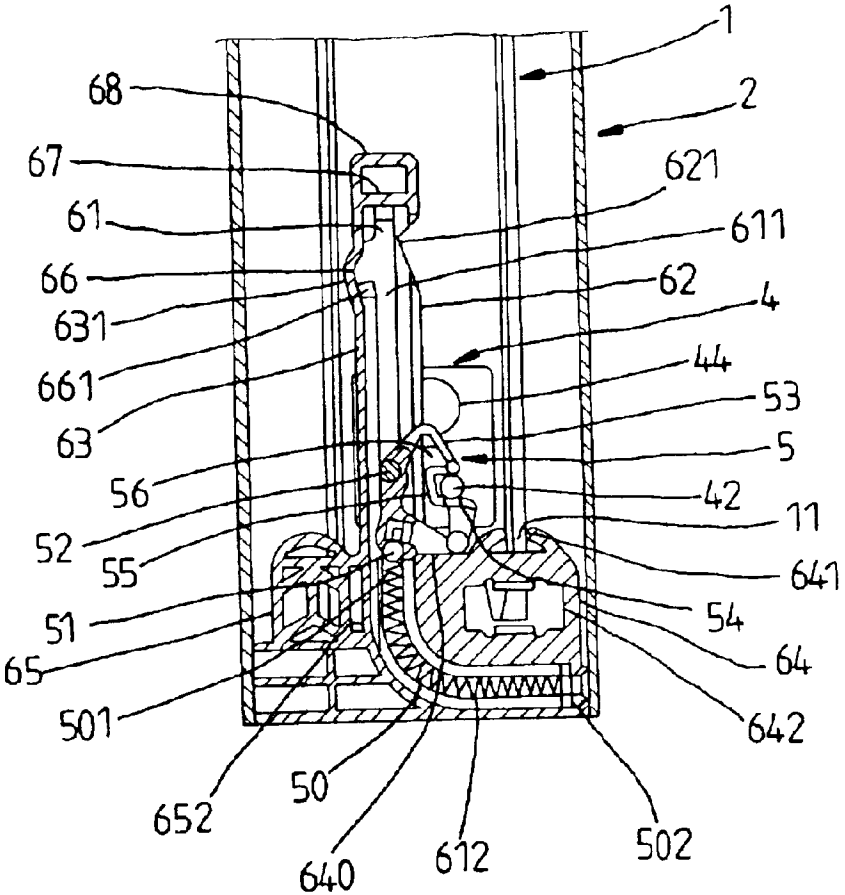
FIG. 16 is a top plain view of the present invention showing the inner sliding rail pushed backwards and forced into engagement with the clamping portion of the first locating block of the track.

When the drawer moved backwards with the inner sliding rail 1 (see FIG. 14), the push rod 42 of the push block 4 pushes the stop wall 54 of the sliding locking block 5, thereby causing the sliding locking block 5 to be biased outwards to force the push rod 42 into engagement with the side locating hole 55 and to disengage the locating rod 52 from the stop block 661. When the locating rod 52 disengaged from the stop block 661, the tensile spring 50 immediately pulls the sliding locking block 5 and the inner sliding rail 1 backwards (see FIG. 15) to the position where the back sidewall 59 of the sliding locking block 5 is stopped at the front sidewall 640 of the first locating block 64 of the track 6 (see FIG. 16). When the back sidewall 59 of the sliding locking block 5 stopped at the front sidewall 640 of the first locating block 64 of the track 6, the rear end of one lateral sidewall 11 of the inner sliding rail 1 is forced into engagement with the clamping portion 641 of the first locating block 64 of the track 6. On the contrary, when the drawer pulled to move the inner sliding rail 1 forwards, the push rod 42 of the push block 4 moves the sliding locking block 5 forwards to the position where the locating rod 52 of the sliding locking block 5 reaches the connection area between the linear front sliding groove portion 611 and the stop block 66. At this time, the push rod 42 of the push block 4 pushes the side locating hole 55 to bias the sliding locking block 5, thereby causing the locating rod 52 to be forced into engagement with the stop block 66 again, and therefore the drawer and the inner sliding rail 1 are stopped in position.

Figure 11:
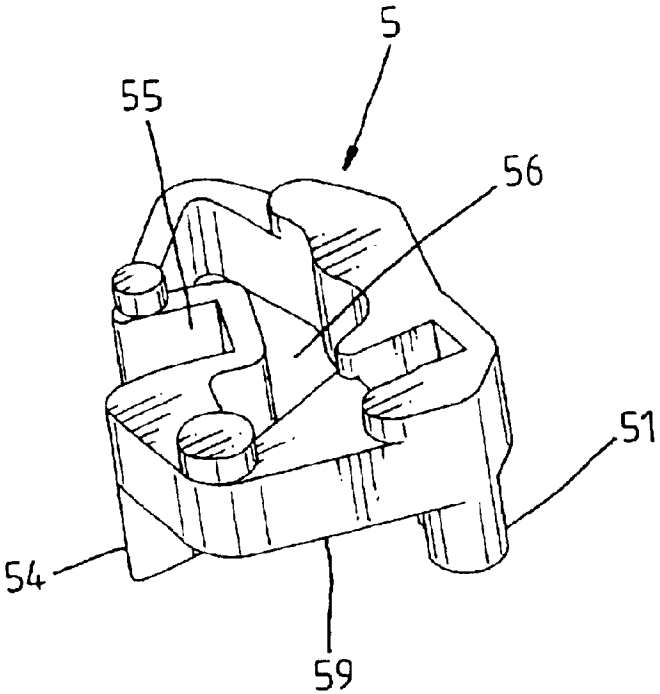
FIG. 11 is an oblique bottom elevation of the sliding locking block shown in FIG. 7.
Figure 10:
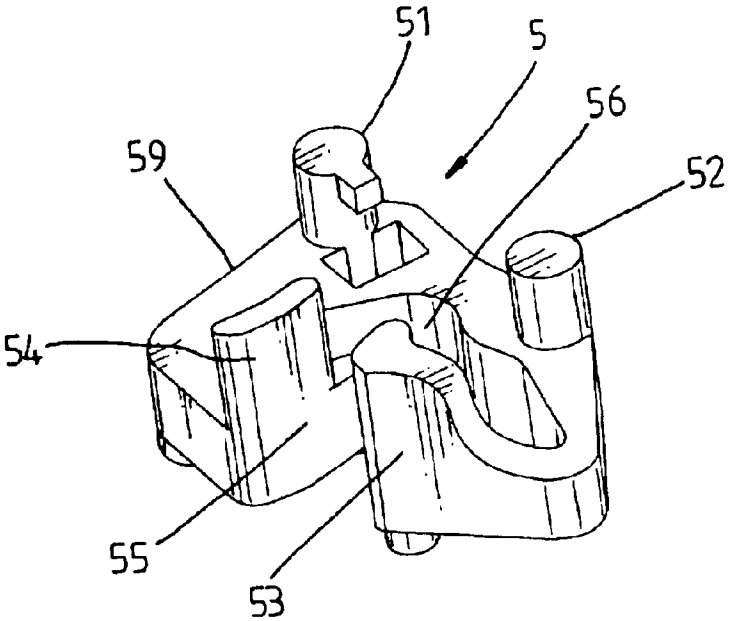
FIG. 10 is an oblique top elevation of the sliding locking block shown in FIG. 7.
Figure 13:
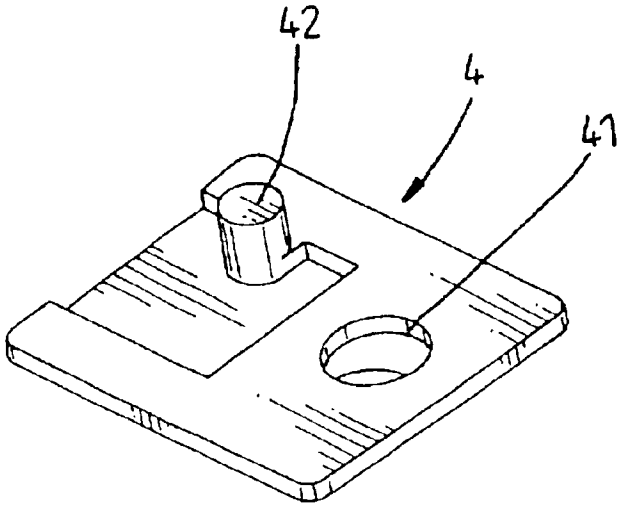
FIG. 13 is an oblique bottom elevation in an enlarged scale of the push block shown in FIG. 2.
Figure 12:
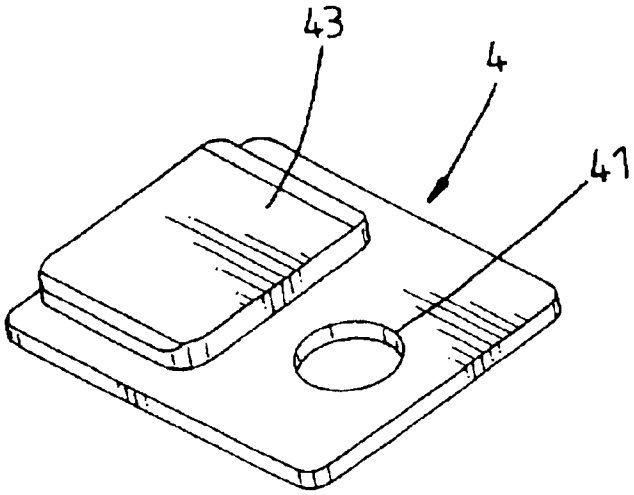
FIG. 12 is an oblique top elevation in an enlarged scale of the push block shown in FIG. 2.

Referring to FIGS. 10 and 11, the sliding locking block 5 has an opening 56 disposed adjacent to the sloping wall 53 and the side locating hole 55. Due to the presence of the opening 56, the sloping wall 53 of the sliding locking block 5 can be deformed by the push rod 42 of the push block 4 for enabling the push rod 42 to move into the side locating hole 55 when the sliding locking block 5 forced by an unexpected external force (for example, vibration) and pulled backwards by the tensile spring 50.

Figure 2:
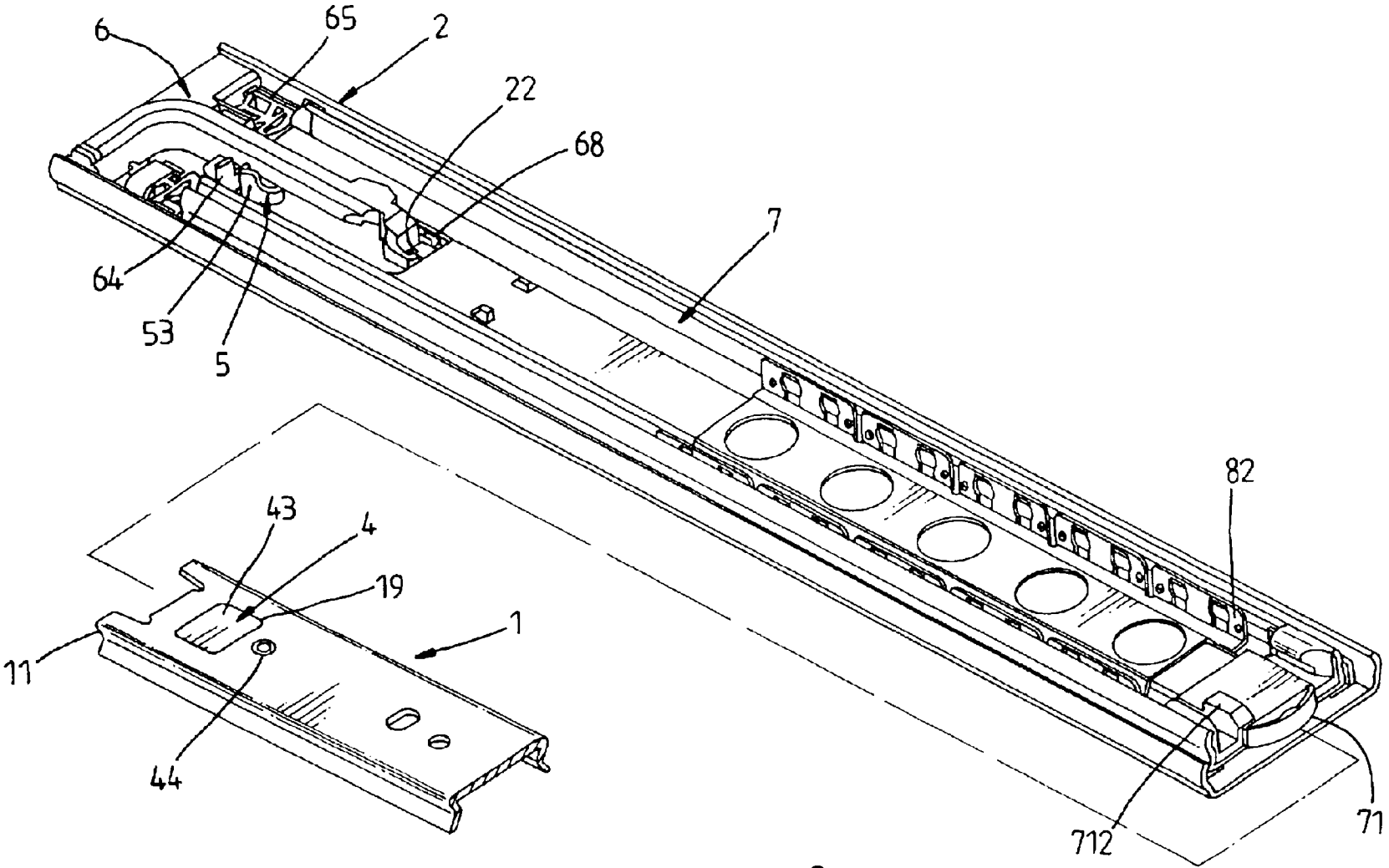
FIG. 2 is an exploded view of the preferred embodiment of the present invention. Showing the inner sliding rail detached from the intermediate sliding rail.
Figure 3:
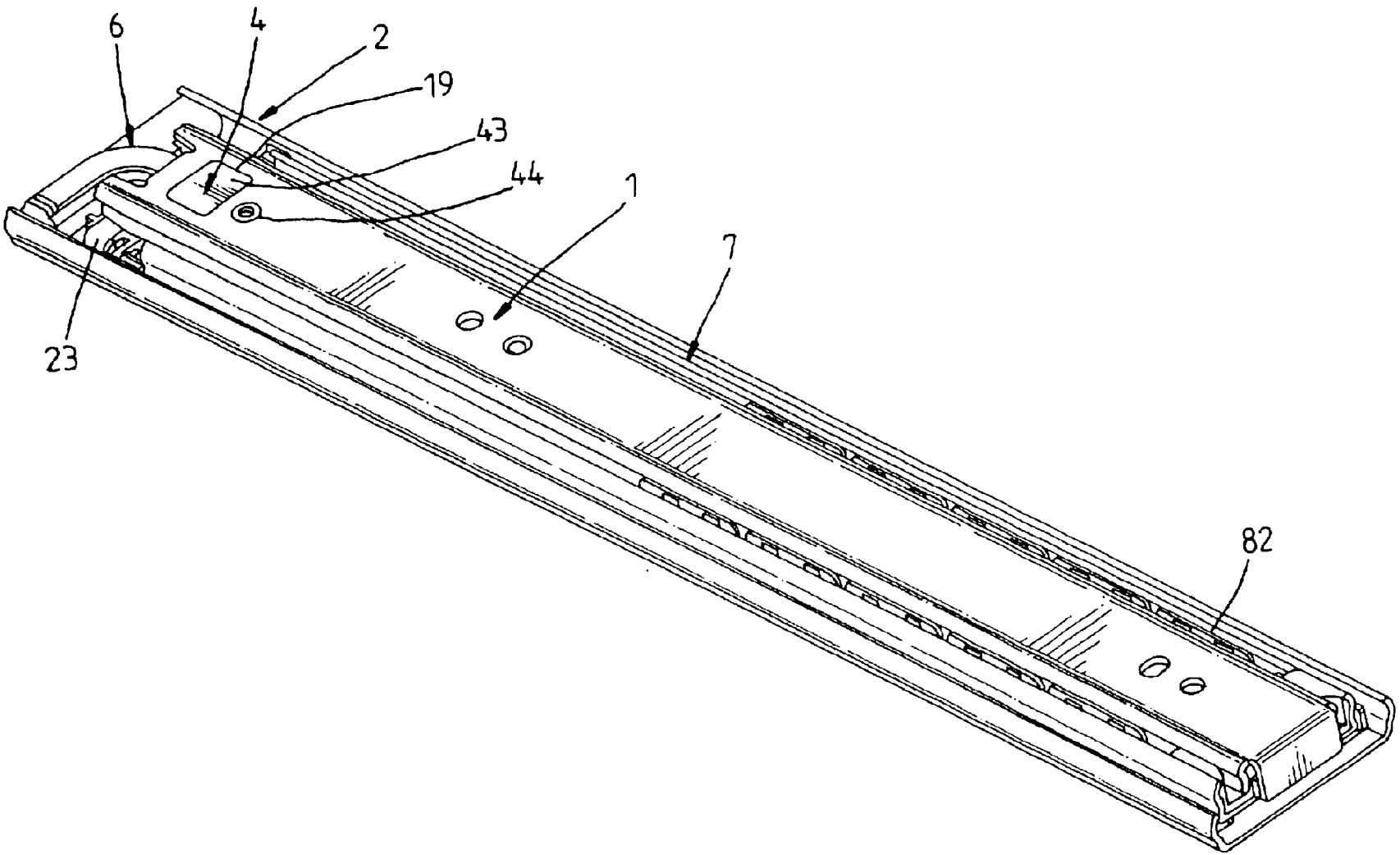
FIG. 3 is an elevational assembly view of the present invention.
Figure 4:
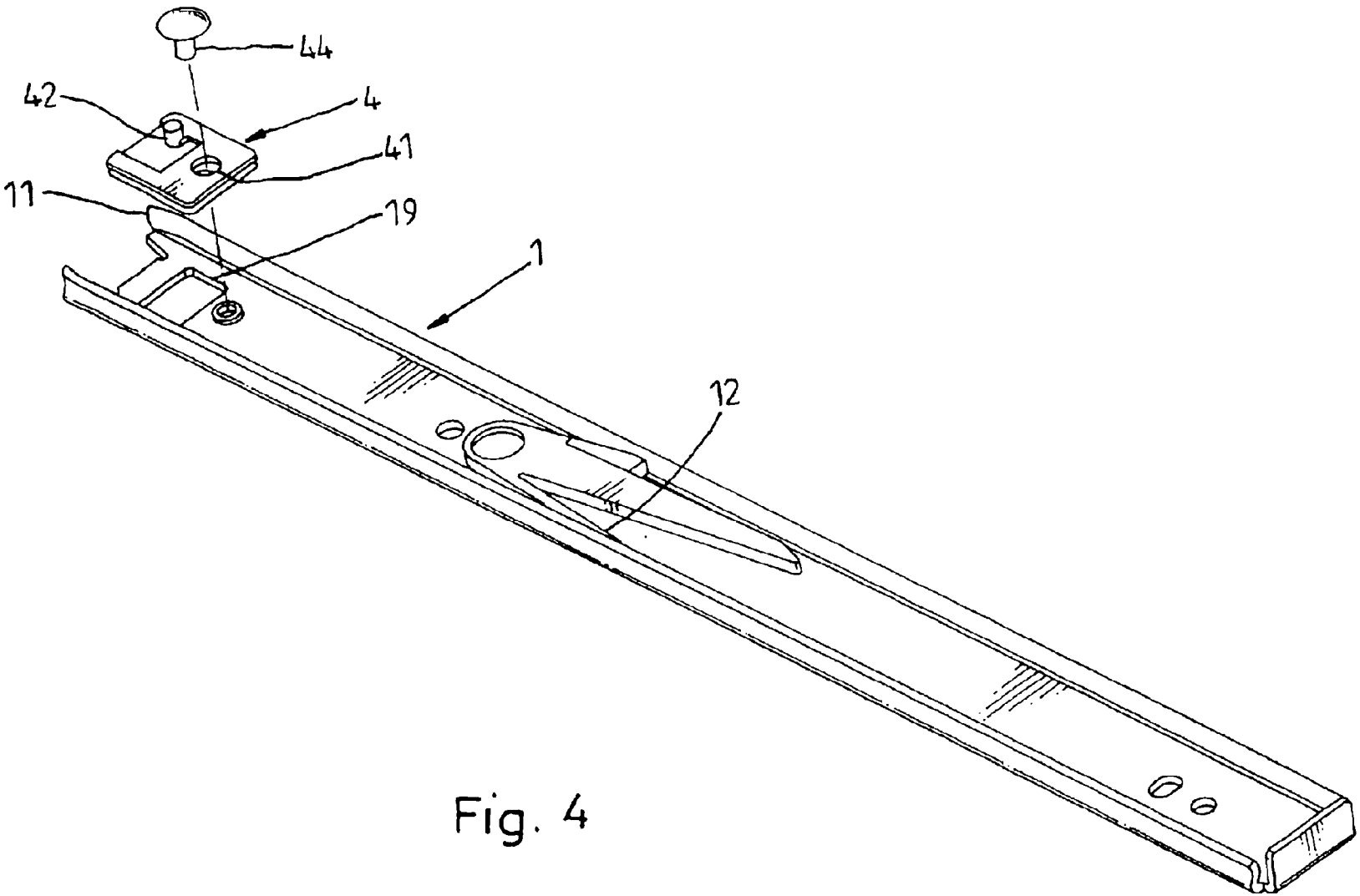
FIG. 4 is an exploded view of the push block and the inner sliding rail according to the present invention.
Figure 5:
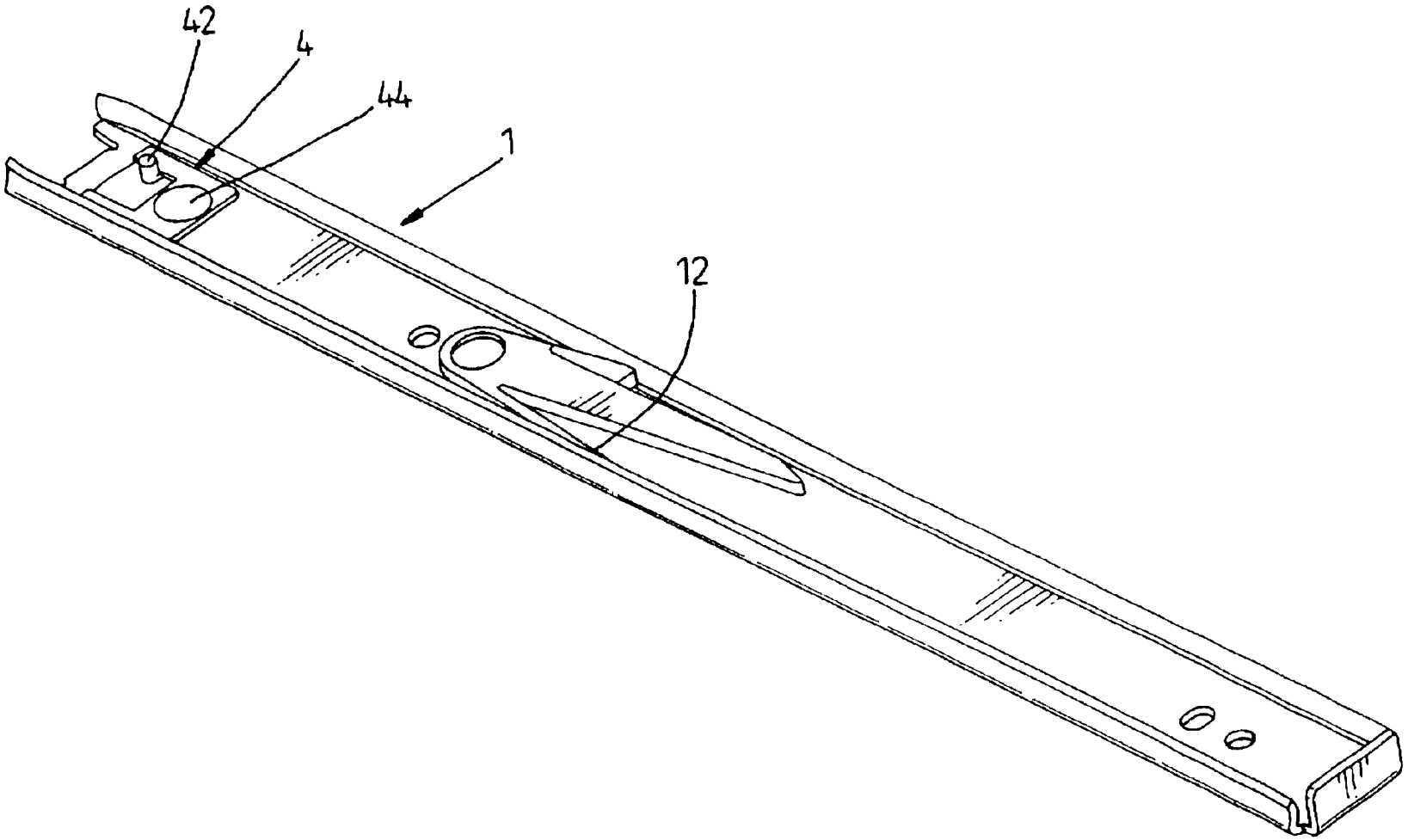
FIG. 5 is an assembly view of FIG. 4.
Figure 6:
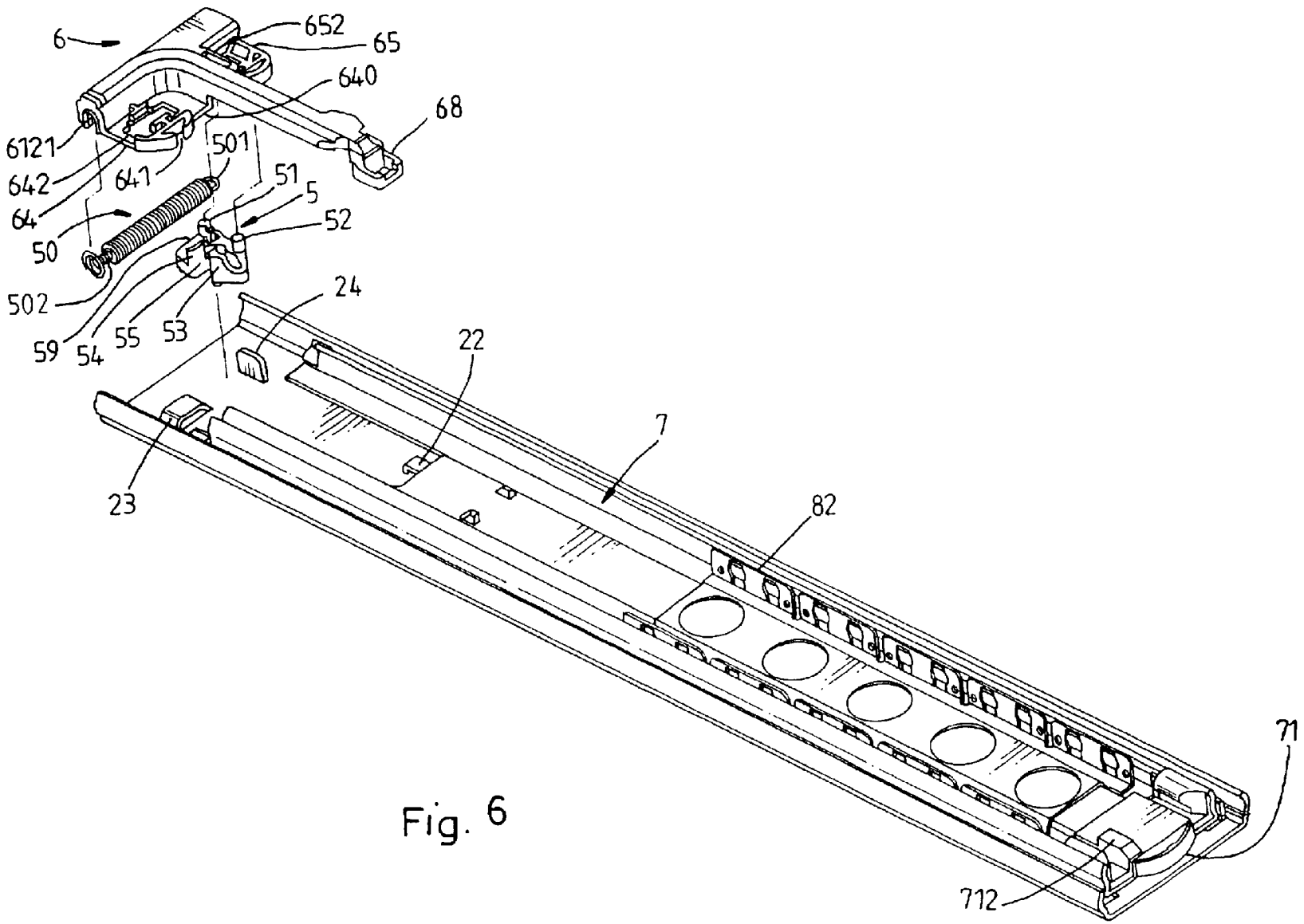
FIG. 6 is an exploded view of the present invention, showing the track, the tensile spring, and the sliding locking block detached from the sliding track assembly.
Figure 8:
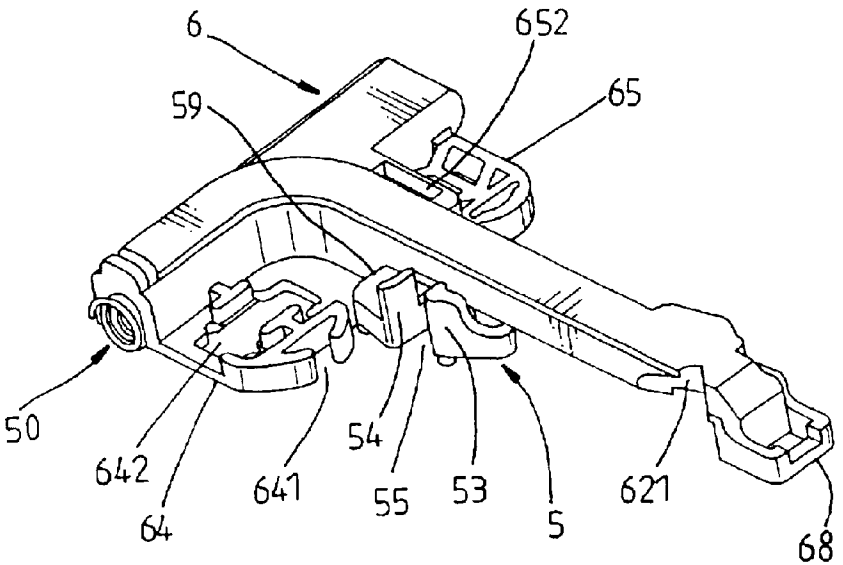
FIG. 8 is an oblique top elevation of the track shown in FIG. 7.

The track 6 has a locating open frame 68 in front of the front stop wall 67 for the positioning of a hook 22 of the outer sliding rail 2 (see FIG. 2), and two locating holes 642 and 652 respectively formed in the first and second locating blocks 64 and 65 for the positioning of locating rods 23 and 24 of the outer sliding rail 2 respectively.

During installation, the two ends 501 and 502 of the tensile spring 50 are respectively fastened to the hook rod 51 of the sliding locking block 5 and the retaining hole 6121 in between the second locating block 65 and the rear side of the arched rear sliding groove portion 612 of the track 6, keeping the locating rod 52 of the sliding locking block 5 in the linear front sliding groove portion 611, and then the track 6 is fixedly fastened to the outer sliding rail 2.

As indicated above, the present invention has the following advantages

1. The track 6 provides a sliding groove 61 formed of a linear front sliding groove portion 611 and a arched rear sliding groove portion 612 and a hook hole 661 biased from the front side of the linear front sliding groove portion 611 to match the sliding locking block 5, which is connected to the track 6 by the tensile spring 50; the design of the locating rod 52, sloping wall 53 and side locating hole 55 of the sliding locking block 5 matches the push rod 42 of the push block 4 to achieve an auto-locking action. Because the track 6 and the sliding locking block 5 have a limited size, they occupy small installation space in the outer sliding rail without affecting the functioning of the sliding track assembly to carry the load.

2. When the inner sliding rail 1 pushed backwards to force the back sidewall 59 of the sliding locking block 5 against the front sidewall 640 of the first locating block 64 of the track 6, the rear end of one lateral sidewall 11 of the inner sliding rail 1 is automatically forced into engagement with the clamping portion 641 of the first locating block 64 of the track 6, and therefore the inner sliding rail 1 is positively held in position.

3. Due to the presence of the opening 56 in the sliding locking block 5 adjacent to the sloping wall 53 and the side locating hole 55, the sloping wall 53 of the sliding locking block 5 can be deformed by the push rod 42 of the push block 4 for enabling the push rod 42 to move into the side locating hole 55 to achieve a locking action when the sliding locking block forced by an unexpected external force and pulled backwards by the tensile spring 50.

4. Because the track 6 has a locating open frame 68 in front of the in front of the front stop wall 67 for the positioning of the hook 22 of the outer sliding rail 2 and two locating holes 642 and 652 respectively formed in the first and second locating blocks 64 and 65 thereof for the positioning of locating rods 23 and 24 of the outer sliding rail 2 respectively, positive connection between the track 6 and the outer sliding rail 2 is assured.

A prototype of auto-locking structure used in a sliding track assembly for drawer has been constructed with the features of FIGS. 2~16. The auto-locking structure used in a sliding track assembly for drawer functions smoothly to provide all of the features discussed earlier.

Although a particular embodiment of the invention has been described in detail for purposes of illustration, various modifications and enhancements may be made without departing from the spirit and scope of the invention.

Accordingly, the invention is not to be limited except as by the appended claims.

What is claimed is:

1. An auto-locking structure used in a sliding track assembly for a drawer, said sliding track assembly comprising an outer sliding rail, an intermediate sliding rail, an inner sliding rail, a first ball bearing plate provided between said outer sliding rail and said intermediate sliding rail, and a second ball bearing plate provided between said intermediate sliding rail and said inner sliding rail, said outer sliding rail being fixedly fastened to an inner sidewall of a desk at one side of a drawer receiving space in said desk, said inner sliding rail being fixedly fastened to one vertical side panel of a drawer to be moved in and out of said drawer receiving space, said intermediate sliding rail comprising a locating block in an outer end thereof, a locking block of said intermediate sliding rail having a protruded engagement portion, said inner sliding rail comprising a retaining strip for detachably engaging the protruded engagement portion of a stop block of said intermediate sliding rail, the auto-locking structure being comprised of a push block, a sliding locking block, a spring member, and a track, said push block having an insert portion press-fitted into a locating hole in a rear end of said inner sliding rail and a mounting hole fixedly fastened to said inner sliding rail by a fastening element, said sliding locking block being fastened to one end of said spring member, said track being fixedly fastened to said outer sliding rail, said block being adapted to push said sliding locking block backwards to a locking position when said drawer is moved with said inner sliding rail backwards to an inside of said drawer receiving space by a user, wherein:

said track comprises a sliding groove formed on a linear front sliding groove portion and an arched rear sliding groove portion, a low stop wall extended along one side of said linear front sliding groove portion, a first locating block at a rear side of said low stop wall adjacent to said arched rear sliding groove portion, a clamping portion protruded from one side of said first locating block, a high stop wall extending along an opposite side of said linear front sliding groove portion, a second locating block at a rear side of said high stop wall opposite to said first locating block, a retaining hole in between said second locating block and said rear arched rear sliding groove portion positioning an opposite end of said spring member, a front stop wall in front of said linear front sliding groove portion, a hook hole located on a front side of said linear front sliding groove portion behind said front stop wall, and a stop block provided between said hook hole and said linear front sliding groove portion, said high stop wall having an outwardly curved protruded portion extended along one side of said hook hole, said low stop wall having a front notch corresponding to the outwardly curved protruded portion of aid high stop wall;

said sliding locking block comprises a hook rod and a locating rod respectively inserted into the linear front sliding groove portion of said sliding groove of said track of guide movement of said sliding locking block in said sliding groove, a sloping wall and a stop wall disposed at one side opposite to said hook rod and said locating rod, a side locating hole defined between said sloping wall and said stop wall;

said push block comprises a push rod;

when said drawer is moved backward with said inner sliding rail by the user, said push rod of said push block pushes the stop wall of said sliding locking block, thereby causing said sliding locking block to be biased outwards to force said push rod into engagement with the side locating hole of said sliding locking block, and at the same time causing said sliding locking block to disengage said locating rod from the stop block of said track, for enabling said spring member to pull said sliding locking block and said inner sliding rail backwards to a position where a back sidewall of said sliding locking block is stopped at a front sidewall of the first locating block of said track, and a rear end of one lateral sidewall of said inner sliding rail is forced into engagement with the clamping portion of the first locating block of said track;

when said drawer is pulled by the user to move said inner sliding rail forwards, the push rod of said push block moves the sliding locking block forward to a position where the locating rod of said sliding locking block reaches a connection area between said linear front sliding groove portion and the stop block of said track, and at the same time the push rod of said push block pushes the side locating hole of said sliding locking block to bias said sliding locking block, thereby causing the locating rod of said sliding locking block to be force into engagement with the stop block of said track again to hold said drawer and said inner sliding rail in position.

2. The auto-locking structure used in a sliding track assembly for drawer as claimed in claim 1 wherein said sliding locking block has an opening disposed adjacent to said sloping wall and said side locating hole for enabling said sloping wall to be deformed by the push rod of said push block to let the push rod of said push block move into said side locating hole when said sliding locking block is accidentally forced by an external force and pulled backwards by said spring member.

3. The auto-locking structure used in a sliding track assembly for drawer as claimed in claim 1 wherein said track comprises a locating open frame in front of said front stop wall positioning a hook of said outer sliding rail, and two locating holes respectively formed in the first and second locating blocks of said track positioning locating rods of said outer sliding rail respectively.

* * * * *